United States Patent [19]

Rutten

[11] 4,277,965

[45] Jul. 14, 1981

[54] CENTRIFUGAL SHOTTING TURBINE

[75] Inventor: Léon Rutten, Liege, Belgium

[73] Assignee: Cockerill, Seraing, Belgium

[21] Appl. No.: 60,167

[22] Filed: Jul. 24, 1979

Related U.S. Application Data

[63] Continuation-in-part of Ser. No. 962,190, Nov. 20, 1978, abandoned.

[30] Foreign Application Priority Data

Nov. 24, 1977 [BE] Belgium ..... 46239

[51] Int. Cl.[3] ..... B24C 3/24

[52] U.S. Cl. ..... 72/53; 51/435

[58] Field of Search ..... 72/53; 29/DIG. 36; 51/435, 434, 319, 320, 321, 424, 410, 419, 423

[56] References Cited

U.S. PATENT DOCUMENTS

| | | | |
|---|---|---|---|
| 2,108,211 | 2/1938 | Rosenberger | 51/434 |
| 2,819,562 | 1/1958 | Barnes | 51/435 |
| 3,241,266 | 3/1966 | Bowling | 51/434 |
| 3,352,064 | 11/1967 | De Groot | 51/434 |
| 3,383,804 | 5/1968 | Haider | 51/434 |
| 3,678,629 | 7/1972 | Leliaert | 51/434 |
| 3,745,711 | 7/1973 | Haberlin | 51/435 |
| 3,785,105 | 1/1974 | Freeman | 51/435 |
| 3,872,624 | 3/1975 | Ramasamy | 51/435 |
| 3,945,150 | 3/1976 | Beckner | 51/435 |
| 4,028,851 | 6/1977 | Fricke | 51/424 |
| 4,047,843 | 9/1977 | Zeidler | 51/434 |

FOREIGN PATENT DOCUMENTS

| | | | |
|---|---|---|---|
| 862932 | 2/1978 | Belgium . | |
| 834341 | 3/1952 | Fed. Rep. of Germany | 51/434 |
| 559084 | 2/1975 | Switzerland | 51/435 |
| 518803 | 3/1940 | United Kingdom | 51/435 |
| 743381 | 1/1956 | United Kingdom | 51/434 |

*Primary Examiner*—Lowell A. Larson
*Assistant Examiner*—Gene P. Crosby
*Attorney, Agent, or Firm*—Spencer & Kaye

[57] ABSTRACT

A centrifugal shotting turbine having easily replaceable blades shaped so as to project shot at a high rate of ejection in a concentrated jet. The turbine comprises a plurality of curved blades, each having a convex-concave working surface and longitudinal fillets extending from opposite edges thereof. The fillets fit into corresponding grooves in the flanges between which the blades are interposed and are secured therein by bearing pins and springs.

6 Claims, 7 Drawing Figures

CENTRIFUGAL SHOTTING TURBINE

BACKGROUND OF THE INVENTION

This application is a continuation-in-part of copending U.S. Application Ser. No. 962,190 filed Nov. 20th, 1978, now abandoned.

The present invention relates to a shotting turbine. In particular, it relates to a shotting turbine wherein the rate of ejection of the shot and concentration of the jet containing the shot is superior to that of known shotting turbines. Further, in accordance with my invention, the turbine blades, when worn, are easily removed and replaced.

A shotting turbine is used to project shot onto the surface of a metal part so as to give the surface of the part a desired state of roughness. Such turbines, which are conventionally of the centrifugal type, comprise a pair of flanges, a central delivery device which provides a supply of shot, and a plurality of blades or vanes attached to one or both flanges and arranged radially around the delivery device. The effective surfaces of these blades are usually plane and of uniform width, and the method of attachment makes the blades difficult to remove and replace.

The impact of a particle can be expressed in terms of its energy $E=(m\ V_R^2)/2$, where m is the mass of the particle, and $V_R$ is the rate of ejection.

The conventional straight blade arrangement projects the shot at a rate of ejection which is directly dependent on the rate of rotation of the turbine. However, in certain cases, this rate is too low to obtain the desired degree of roughness.

For example, rolling-mill rolls are often so hard that the desired degree of roughness cannot be achieved with a straight blade arrangement. Like any machine, the shotting turbine has a limiting speed which cannot be exceeded with safety and without undue wear. The straight blade arrangement limits the rate of ejection of the shot to a value corresponding to the maximum rate of rotation of the turbine.

Moreover, the differential wear of the blades and the flanges often causes imbalances which prevent very high rates of rotation from being effected. As is known, these imbalances are a function of the square of the rate of rotation.

The straight blade arrangement is also disadvantageous because it produces a jet of shot which is spread out both in the direction of movement of the turbine and in the transverse direction. To take a specific example, with a turbine rotating at a speed of 2,500 revolutions per minute and having straight blades with a uniform width of 60 mm, the spreading of the jet gives at a distance of 500 mm from the turbine a jet having an impact length of approximately 793 mm and an impact width of approximately 80 to 90 mm. It has been established that if the central part of the jet produces a uniform roughness on the surface which it touches, the marginal parts of the spread jet contain particles of shot which rebound on the surface to be shot, break down and have an impact effect which is prejudicial to the efficiency of the operation. This spreading of the jet thus appreciably limits the impact force of the jet and is especially troublesome in the shotting of parts which have a curved surface.

The blades of the shotting turbines wear rapidly, primarily as a function of the speed of rotation of the turbine. Accordingly it is necessary to replace them at frequent intervals.

SUMMARY OF THE INVENTION

An object of the invention is to provide a shotting turbine having blades profiled so as substantially to improve the rate of ejection of the shot and the concentration of the jet.

Another object of the invention is to provide a shotting turbine having blades which, when worn, can easily and rapidly be replaced.

A higher rate of ejection has definite advantages. In the first place, to obtain the same level of roughness the rate of rotation can be reduced from that required with a lower ejection rate. The rate of rotation of the turbine is an important element since, in a shotting turbine, the differential wear of the blades and flanges brings about troublesome imbalances (vibrations). These imbalances are a direct function of the square of the rate of rotation and are decreased by reducing the rate of rotation. It is important to minimize as much as possible these disruptive forces and an extremely effective means is to reduce the rate of rotation of the turbine.

On the other hand, a higher rate of ejection than is possible with the straight blade arrangement permits higher degrees of roughness to be obtained for the same rate of rotation. In the particular case of rolling-mill rolls, the roll hardnesses achieved at the present state of the art cannot be increased since it would then be impossible to attain the required degree of roughness. Thus, a compromise must be accepted between the desired degree of roughness and the roll hardness, the roll hardness being made as high as possible while still permitting attainment of the required degree of roughness.

For example, with angular shot composed of particles havng an average size of 0.40 mm and with a roll hardness of 730–750 Vickers hardness under a load of 30 kg (HV), the maximum degree of roughness reached is 200 $\mu''$ (CLA: Center Line Average). If the roll hardness is increased by 30 points on the Vickers hardness scale, the maximum possible degree of roughness will be, for example, 170$\mu''$ (CLA).

The improvement in the concentration of the jet of shot brings about a reduction in the spread of the jet, the effect of which is to increase the impact power of the jet for the same delivery of shot.

According to the invention there is provided a centrifugal shotting turbine comprising two parallel spaced flanges having a central axis perpendicular to the surfaces of the flanges. Interposed between the flanges and coaxial with the central axis is a shot delivery device. Also interposed between the flanges are a plurality of blades extending radially outward from the delivery device. Each blade is provided with a pair of longitudinal fillets extending from opposite edges thereof and has a working face with a longitudinal profile that, starting from the delivery device is first convex in shape and then concave.

Each of the flanges is provided with a plurality of radially extending opposite grooves on its inside face which receive the fillets on the turbine blade. Further, each groove contains a bearing pin at its outer end and a spring at its inner end which retain the turbine blade fillets firmly in position while permitting the blades to be easily removed and replaced. A fastening arrangement of this type is disclosed in my Belgian Patent No. 862,932 granted Feb. 15, 1978.

The working face of each blade preferably has a width which decreases progressively from its foot to its head.

BRIEF DESCRIPTION OF THE DRAWINGS

Exemplary embodiments of the invention are described hereinafter by reference to the attached drawings wherein.

DESCRIPTION OF THE PREFERRED EMBODIMENTS

Figure 1:
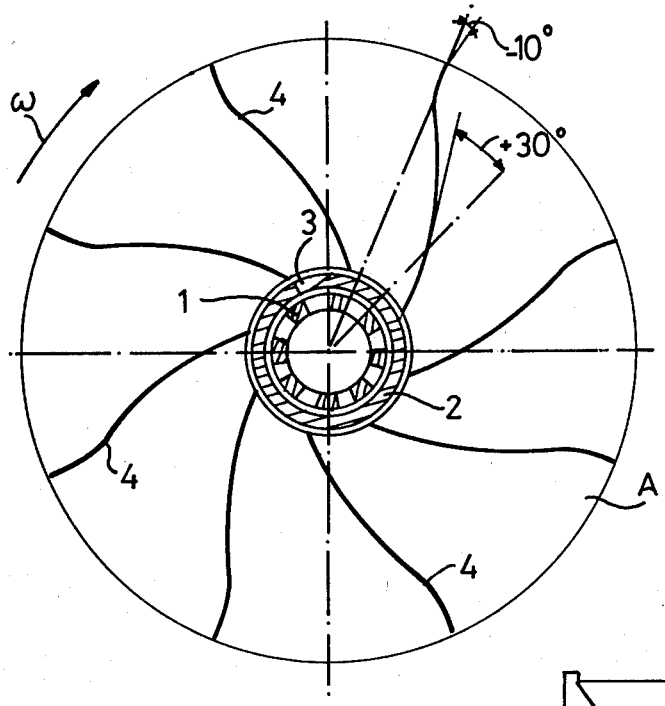
FIG. 1 is a schematic cross-section of a turbine according to the invention.

FIG. 1 shows a schematic cross-section of a shotting turbine according to the invention. Arranged around a shot delivery device 1 is a regulator 2 which consists of a casing pierced by an opening 3. The size of the opening 3 is a function of the turbine and of the shotting work to be carried out. A plurality of blades 4 fixed between two flanges, one of which is shown at A on the drawing, are arranged uniformly around the regulator 2. The turbine is assumed to be driven in the direction of rotation indicated by the arrow $\omega$.

According to the invention the working faces of the blades 4 have a longitudinal profile composed, starting from the delivery device 1, of a convex part followed by a concave part. The convex and concave parts can have uniform or variable angles of curvature.

Figure 2:
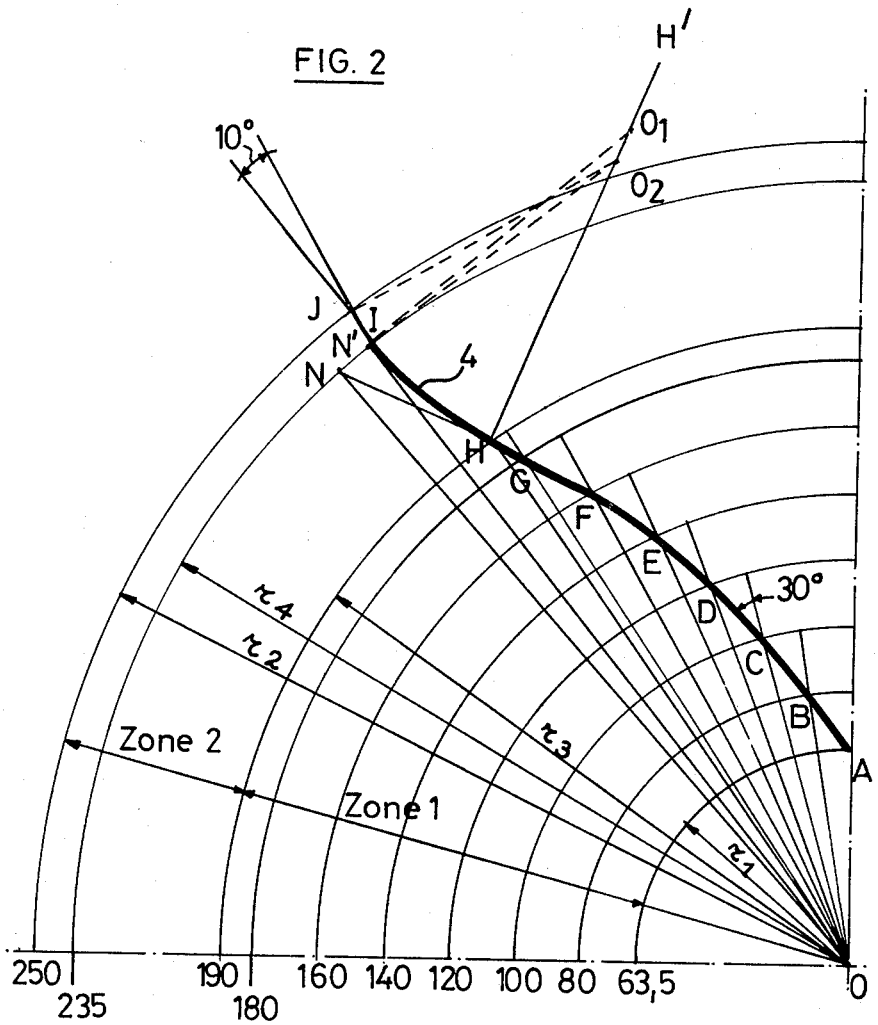
FIGS. 2 and 3 are two embodiments of the longitudinal profile of a blade of the turbine.

A preferred embodiment of a profile having a double curvature according to the invention is illustrated in FIG. 2. This profile is divided into two zones.

In zone 1, which extends as far as the radius $r_3=190$ mm in the illustrated embodiment, the working face of the blade is convex with a uniform angle of curvature. In the embodiment shown, this angle is 30°. At each of the points A, B, C, D, E, F, G and H the tangent at this point to the profile of the effective face forms an angle of 30° with the radius passing through this point. The number of points is selected so as to obtain a polygonal curve practically identical to the theoretical curve.

A zone 2 extends from the radius $r_3=190$ mm as far as the radius $r_2=250$ mm in the embodiment illustrated in FIG. 2. In this zone 2, the working face of the blade is concave with an angle of curvature variable between the value of 30° and the value of $-10°$ selected as an example of the exit angle. The variation of the angle of curvature is therefore $30°-(-10°)=40°$. The curve is adjusted in proportion to the two angles of curvature, namely: 30/40 to adjust the angle $\alpha_1=30°$ at the radius $r_3=190$ mm to $\alpha=0°$ at the radius $r_4=235$ mm; 10/40 to adjust the angle $\alpha=0°$ at the radius $r_4=235$ mm to the value $\alpha_2=-10°$ at the radius $r_2=250$ mm.

The profile in this zone 2 can be plotted in the following manner. Draw from the point H a straight line forming an angle of 30° with the radius HO; this straight line bisects the circumference of radius $r_4=235$ mm at the point N. Mark the radius NO and draw at the point N the perpendicular to this radius NO. Likewise, draw through the point H the perpendicular to HN, that is, HH'; the intersection of the perpendicular at N and the straight line HH' defines the point $O_1$. With $O_1$ taken as the center, draw a segment of a circle of radius $O_1H$; this segment of circle bisects the circumference of radius $r_4$ at the point N'. Draw through this point the perpendicular to the radius N'O to define the point $O_2$ on the straight line HH'. With this point $O_2$ selected as the new center, plot a segment of circle of radius $O_2H$ which bisects the circumference of radius $r_2$ at the point J. As will be noted, a step-by-step operation is required, but two locations of centers ($O_1$, $O_2$) are sufficient for the accuracy required.

It has been found by computation that a turbine having blades conforming to the profile of FIG. 2 and rotating at a speed of 2,500 revolutions per minute provides a theoretical rate of ejection of shot of 92.62 m/s as compared with a calculated theoretical rate of ejection of 77.65 m/s for a turbine with straight blades rotating at the same speed. Thus, the improvement in the theoretical rate of ejection is approximately 20% .

Figure 3:
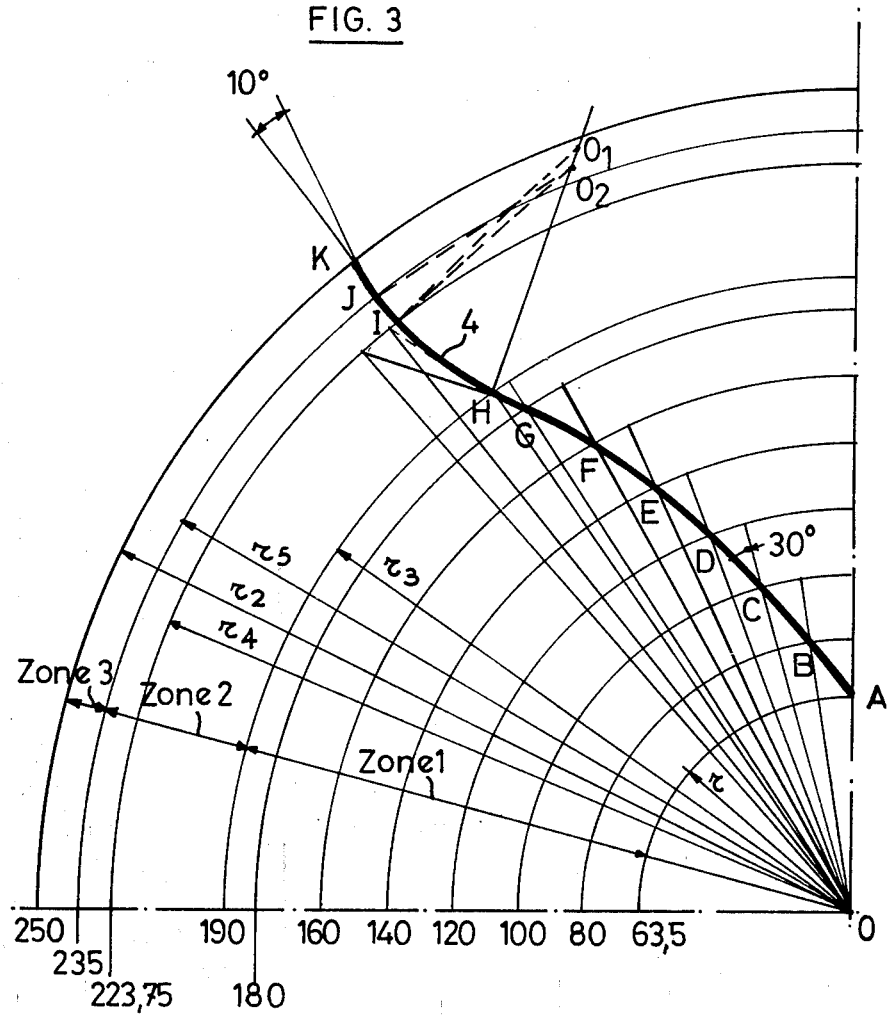

FIG. 3 shows a second embodiment of a blade with double curvature according to the invention. In this embodiment the profile is divided into three zones: zones 1 and 2 correspond to the two zones of the embodiment of FIG. 2 and zone 3 is a zone in which the angle of curvature is constant. The profile shown in FIG. 3 thus comprises a line convex to the constant angle of curvature (zone 1), a line concave to the variable angle of curvature (zone 2) and a line concave to the constant angle of curvature (zone 3). This profile having three zones is plotted as in the case of the profile having two zones for the zones 1 and 2; in zone 3 it can be plotted as for the line of zone 1. In the embodiment shown in FIG. 3, since the outer radius $r_2$ is the same as in the embodiment of FIG. 2, the three zones are distributed as follows: zone 1 as far as the radius $r_3=190$ mm, zone 2 as far as the radius $r_5=235$ mm and zone 3 from the radius $r_5$ to the radius $r_2=250$ mm.

The theoretical rate of ejection of shot calculated for blades having the profile of FIG. 3 for the same rate of rotation of 2,500 revolutions per minute is slightly lower than that obtained with blades having the profile of FIG. 2 (namely, 91.62 m/s instead of 92.62 ms/s). Moreover, there would be a slight increase in the wear of the blades.

Figure 4:
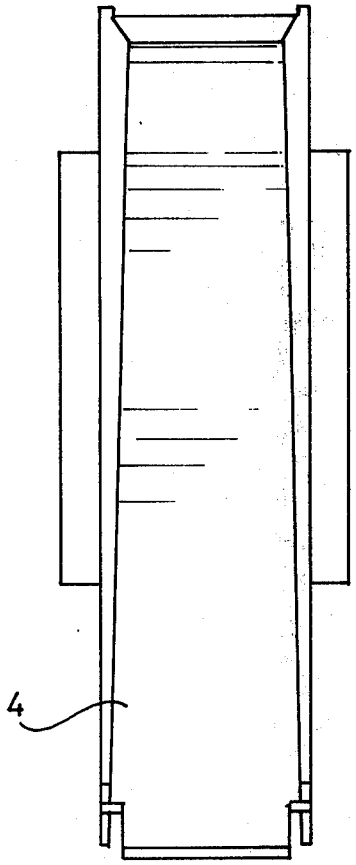
FIG. 4 is a front view of one embodiment of the shotting turbine according to the invention.

To improve the transverse concentratin of the jet of shot, the working face of each blade may have a width which decreases progressively from its foot to its head. This transverse profile is shown in FIG. 4. In a preferred embodiment of the invention, the reduction of the width of the blade is such that the angle between the lateral flanks of the blade is approximately 3°. Owing to this profiling, it is possible to obtain a transverse concentration of the jet which is improved by approximately 48% as compared to a blade arrangement having a uniform width, all other factors being equal. With this blade arrangement the projection of marginal particles in a transverse direction is substantially reduced, so that the power and effectiveness of the impact are considerably improved.

Figure 5:
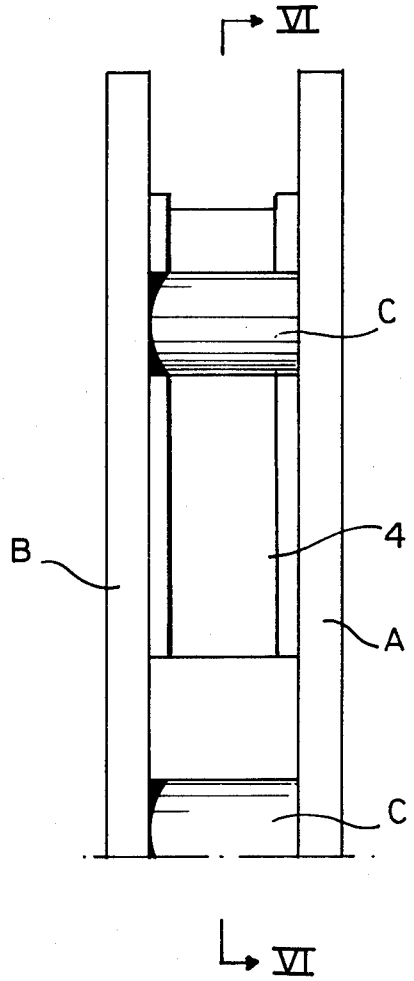
FIG. 5 is a front view of another embodiment of a shotting turbine according to the invention.
Figure 6:
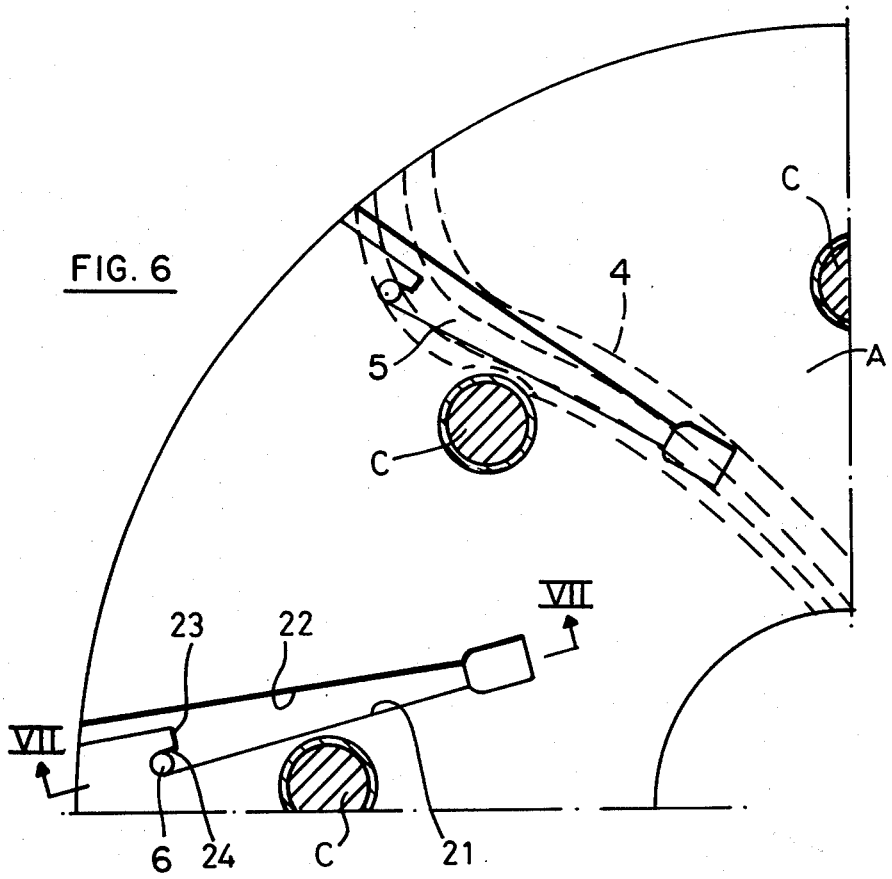
FIG. 6 is a sectional view along the line VI—VI of FIG. 5.
Figure 7:
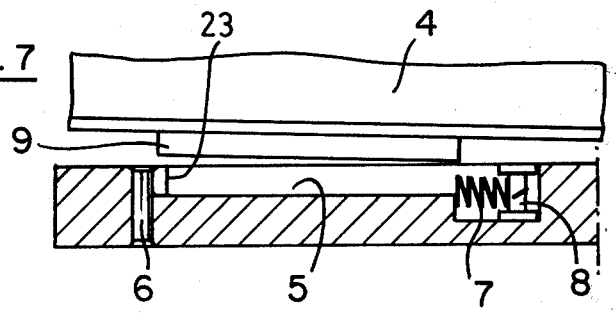
FIG. 7 is a sectional view along the line VII—VII of FIG. 6 showing a disengaged blade.

FIGS. 5–7 show details of the arrangement for attaching a plurality of turbine blades 4 to two flanges A and B. As illustrated in FIGS. 5 and 6, the flanges A and B are connected by a plurality of shafts C and a plurality of blades 1 are interposed between the flanges The blades are attached to each of the flanges A and B by means of the arrangement shown in FIGS. 6 and 7 which show in broken lines the position of the longitudinal profile of a blade 4 having a curved profile. Each flange has on its inside face a plurality of radially extending grooves 5, each containing (see FIG. 7) a bearing pin 6 at its outer end and a spring 7 accommodated at its inner end. The spring 7 is held in place by a retaining member 8. Each groove 5 is intended to receive a fillet 9 provided longitudinally on each side of each blade. FIG. 7 shows a blade 4 ready to be engaged in one of the grooves.

To facilitate the insertion and disengagement of a fillet 9 in a groove 5, the latter is advantageously composed of two parts: the first part 21 secures the fillet and the second part 22 is used for insertion or removal of the fillet. The two parts 21 and 22 of the groove 5 have relatively offset angular positions so as to form between them a ledge 23 defining at the outer end of the part 21 a slot 24 to accommodate the bearing pin 6. When the fillet 9 is inserted into a groove 5, the spring 7 exerts a longitudinal pressure on the fillet which presses the fillet against the bearing pin 6 thus retaining the fillet firmly in the groove.

In the illustrated embodiment, the spring 7 biases the fillet towards the bottom of the slot 24 and the ledge 23 retains the outer end of the fillet 9 in position. When the turbine rotates, the fillets are carried and wedged in the slots 24 by centrifugal force, the ledges 23 ensuring that the curved blade will be wedged tightly and securely.

The shotting turbine according to the invention provides blades profiled so as to substantially improve the rate of ejection of the shot and the concentration of the jet. At the same time, means are provided for easily removing worn blades and replacing them with new ones. The turbine is simple in construction and the blades are securely and safely secured between the flanges.

It will be understood that the above description of the present invention is susceptible to various modifications, changes and adaptions, and the same are intended to be comprehended within the meaning and range of equivalents of the appended claims.

What is claimed is:

1. A centrifugal shotting turbine comprising:

a pair of parallel spaced flanges having a common central axis perpendicular to the surfaces thereof, each of said flanges having a plurality of radial grooves extending to the outer rim of said flanges on the inside surface thereof;

a shot delivery device interposed between said flanges and coaxial with said central axis;

a plurality of bearing pins, one of said pins being located in each of said radial grooves at the end remote from said central axis;

a plurality of springs, one of said springs being located in each of said radial grooves at the end nearest said central axis;

a plurality of blades each having a pair of longitudinal fillets extending from opposite edges thereof, the working face of each of said blades having a longitudinal profile which is convex adjacent said delivery device and concave at greater radial distances from said delivery device, the radial fillets on each of said blades fitting into corresponding grooves on said flanges between said bearing pins and said springs, the pressure of said springs securely holding said blades in position between said flanges, said blades being easily replaced and being shaped so as to project shot at a high rate of ejection in a concentrated jet.

2. A turbine according to claim 1 wherein each of the grooves in said flanges comprises first and second parts separated by a ledge near the end of said groove remote from said central axis, said first part including a recess containing said bearing pin on one side of said ledge for receiving one end of said fillet and retaining it therein, said second part extending to the rim of said flange on the other side of said ledge to permit the insertion and removal of said blade.

3. A turbine according to claim 1, wherein the convex part has a uniform angle of curvature.

4. A turbine according to claim 1, wherein the convex part has a variable angle of curvature.

5. A turbine according to claim 1, wherein the concave part comprises a zone having a variable angle of curvature.

6. A turbine according to claim 1, wherein the concave part comprises a zone having a variable angle of curvature and a zone having a uniform angle of curvature.

* * * * *